US006182446B1

(12) United States Patent
Günther et al.

(10) Patent No.: US 6,182,446 B1
(45) Date of Patent: Feb. 6, 2001

(54) INTERNAL COMBUSTION ENGINE WITH AT LEAST TWO CYLINDER BANKS

(75) Inventors: Josef Günther, Affalterbach; Herbert Klein, Leutenbach; Dieter Langrock, Remshalden, all of (DE)

(73) Assignee: DaimlerChrysler A.G., Stuttgart (DE)

( * ) Notice: Under 35 U.S.C. 154(b), the term of this patent shall be extended for 0 days.

(21) Appl. No.: 09/270,939

(22) Filed: Mar. 16, 1999

(30) Foreign Application Priority Data

Mar. 19, 1998 (DE) ..... 198 12 090

(51) Int. Cl.[7] ..... F02M 25/06
(52) U.S. Cl. ..... 60/278; 60/300; 60/302
(58) Field of Search ..... 60/278, 300, 302, 60/322

(56) References Cited

U.S. PATENT DOCUMENTS 5,782,088 * 7/1998 Gunther et al. ..... 60/278

FOREIGN PATENT DOCUMENTS

| | | |
|---|---|---|
| 44 31 058 | 8/1995 | (DE) . |
| 196 11 363 | 6/1997 | (DE) . |
| 2 311 330 | 9/1997 | (DE) . |
| 2 304 602 | 3/1997 | (GB) . |
| 8-177472 | 7/1996 | (JP) . |
| 9-112254 | 4/1997 | (JP) . |

* cited by examiner

*Primary Examiner*—John A. Jeffery
(74) *Attorney, Agent, or Firm*—Klaus J. Bach

(57) ABSTRACT

In a multi-cylinder internal combustion engine having at least two cylinder banks each with an exhaust system including a catalytic converter, wherein one of the cylinder banks can be deactivated when the engine operates only under partial load, the exhaust systems have exhaust pipe sections which are interconnected by a cross-over structure disposed upstream of the catalytic converters so that exhaust gas can flow also through the catalytic converter of the deactivated cylinder bank, and a length compensating element is disposed in at least one of the exhaust pipe sections and the cross-over structure.

6 Claims, 1 Drawing Sheet

INTERNAL COMBUSTION ENGINE WITH AT LEAST TWO CYLINDER BANKS

BACKGROUND OF THE INVENTION

The invention relates to a multi-cylinder internal combustion engine with at least two cylinder banks each of which includes an exhaust system with a catalytic converter wherein one of the cylinder banks can be made inoperative during partial load operation of the engine.

DE 196 11 363 C1 discloses a multi-cylinder internal combustion engine including two cylinder banks each having several cylinders wherein one of the cylinder banks is always operative while the other can be inactivated during partial load operation. Each cylinder bank is provided with an exhaust system including a catalytic converter. Downstream of the catalytic converters, the separate exhaust gas systems are joined in a common exhaust pipe section, which is then again split to feed two mufflers through which the exhaust gas is discharged to the atmosphere.

During partial load operation, a vacuum is generated in the exhaust system associated with the inactivated cylinder bank upstream of the respective catalytic converter so that the exhaust gas of the operational cylinder bank first flows through its associated catalytic converter. Then however it is returned, by way of the common exhaust pipe section and the catalytic converter of the inactivated cylinder bank, to the cylinders of the deactivated cylinder bank. In this way, the catalytic converter of the deactivated cylinder bank is maintained at operating temperature also during partial load operation so that the exhaust gas emissions are maintained at minimum level when the inactivated cylinder bank is reactivated.

It is the object of the present invention to reliably maintain the catalytic converter of the cylinder bank, while inactivated during partial load operation, at operation temperature in a simple manner, specifically without the need for generating a vacuum upstream of the catalytic converter of the inactivated cylinder bank.

SUMMARY OF THE INVENTION

In a multi-cylinder internal combustion engine having at least two cylinder banks each with an exhaust system including a catalytic converter, wherein one of the cylinder banks can be deactivated when the engine operates only under partial load, the exhaust systems are interconnected by a cross-over structure disposed upstream of the catalytic converters so that exhaust gas can flow also through the catalytic converter of the deactivated cylinder bank and a length compensating element is disposed in at least one of the exhaust pipe sections extending between the cylinder banks and the cross-over structure and the cross-over structure.

The cross-over structure interconnecting the exhaust systems of the different cylinder banks upstream of the catalytic converters provides for heating of all the catalytic converters also during partial load operation of the engine. Part of the exhaust gas of the operational cylinder bank or banks is diverted, by way of the cross-over structure, to the catalytic converter of the exhaust system of the deactivated cylinder bank. All catalytic converters are therefore maintained operational. As a result, exhaust emissions will not increase when the deactivated cylinder bank is reactivated.

The heating of the catalytic converter of the exhaust system of the deactivated cylinder bank is achieved without a need for vacuum generating means since the cross-over structure is arranged upstream of the catalytic converters. With this arrangement, a part of the exhaust gas flows automatically through the catalytic converter of the deactivated exhaust system simply because of the lower flow resistance of this parallel passage.

In order to accommodate thermally caused differential length changes of the exhaust pipes between the cylinder banks and the cross-over structure at least one of the exhaust pipe sections upstream of the catalytic converters includes a length compensating element. Different component temperatures and thermally caused differences in the component length can be accommodated by the length compensating element or elements. The high temperature exhaust gas flows through the exhaust pipe section of the operative cylinder bank upstream of the crossover pipe section and also through the cross-over pipe section so that these pipe structures are hot and thermally expanded. The upstream pipe section of the deactivated cylinder bank, however, assumes a substantially lower temperature. As a result, the different pipe sections expand to different degrees. The length difference between the pipe sections is accommodated by the length compensating element, so that cracks and breaks which could make the engine inoperational are avoided.

With the incorporation of a length compensating element in the cross-over pipe section interconnecting the exhaust systems, the cross-over structure may be arranged in close proximity to the engine upstream of the catalytic converters so that both catalytic converters are heated by the exhaust gas even when one cylinder bank is deactivated. The differential expansions of the exhaust pipes are accommodated by the length compensating element.

There may be only a single length compensating element arranged in one of the exhaust pipe sections between the cylinder banks and the cross-over pipe structure or in the cross-over pipe structure. However, preferably several such length compensating elements are provided, that is preferably one in each exhaust pipe section upstream of the cross-over pipe structure. The length compensating elements can accommodate pull (contraction) as well as push (expansion) forces on the pipes.

In one embodiment of the invention, there is additionally provided a vacuum generating means, preferably an exhaust gas re-circulation arrangement with a conduit extending between the exhaust pipe section of the deactivated cylinder bank and the intake duct of the operating cylinder bank. The exhaust gas re-circulation arrangement has the advantage that additional catalytic converters arranged close to the respective cylinder bank or oxygen sensors can be maintained at operating temperature by the re-circulated exhaust gas.

Another advantage of this arrangement is that thermal energy is drained from the re-circulated exhaust gas that is, the exhaust gas is cooled whereby the density of the re-circulated exhaust gas is increased and higher exhaust gas re-circulation rates and a reduction in exhaust gas emissions can be achieved.

Further advantages and embodiments will be described below on the basis of the accompanying drawings.

DESCRIPTION OF PREFERRED EMBODIMENTS

Figure 1:
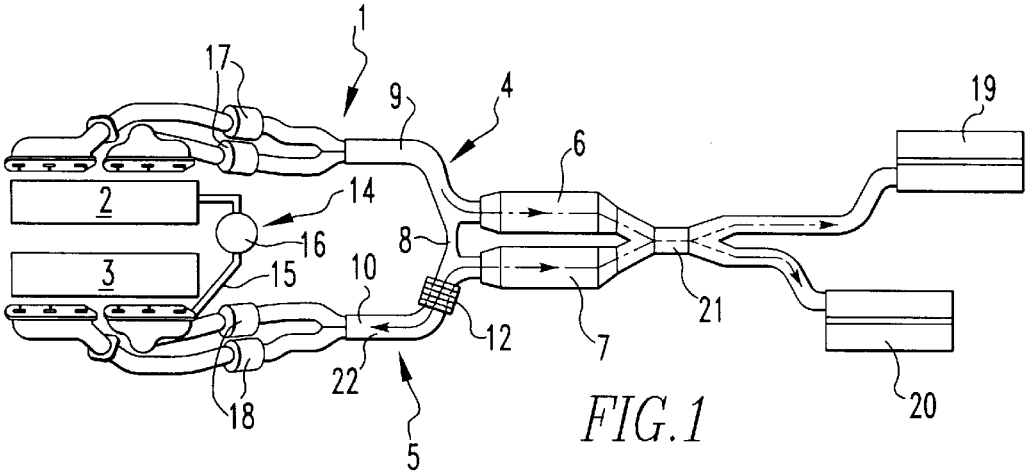
FIG. 1 shows schematically an internal combustion engine with two cylinder banks and two exhaust gas systems.

As shown in FIG. 1, an internal combustion engine 1 comprises two cylinder banks 2, 3 each including several cylinders. Each cylinder bank 2, 3 is provided with an exhaust system 4, 5 and each exhaust system 4, 5 includes pre-catalytic converters 17, 18 with lambda and control sensors arranged up-stream and downstream thereof, a main catalytic converter 6, 7 and a muffler 19, 20. Each of the cylinder banks 2, 3 includes the same number of cylinders. In the embodiment shown in the drawings, each of the cylinder banks 2, 3 includes six cylinders.

The cylinder bank 2 is always in operation; the cylinder bank 3 can be deactivated when the engine is in a partial load operating mode in order to reduce exhaust emissions. Under partial load operation only the first cylinder bank 2 is operative and the exhaust gas therefrom is discharged through the exhaust system 4.

Both exhaust systems 4, 5 are interconnected upstream of the catalytic converters 6, 7 so that, during partial load operation when the cylinder bank 3 is deactivated, exhaust gas of the cylinder bank 2 is discharged partially also through the exhaust system 5 of the deactivated cylinder bank 3. The exhaust systems 4, 5 include, adjacent the engine, exhaust pipe sections 9, 10 which are joined immediately upstream of the catalytic converters 6, 7 by a cross-over pipe section 8. During partial load operation when the cylinder bank 3 is deactivated, a part of the exhaust gas flows from the exhaust system 4 by way of the cross-over pipe section 8 to the exhaust system 5 and through the catalytic converters 7 of the deactivated cylinder bank 3. In this way the catalytic converter 7 is maintained at operating temperature.

Instead of providing a cross-over pipe section, the exhaust gas systems 4, 5 may be combined in a common duct portion upstream of the catalytic converter 6, 7.

Downstream of the catalytic converters 6, 7, the exhaust systems 4, 5 are combined in a common exhaust structure 21. The exhaust duct structure 21 may then again be divided to supply the exhaust gas to two separate mufflers 19, 20. The common exhaust duct structure 21, however, is not needed. The exhaust systems may remain separate downstream of the catalytic converters.

The pipe section 10 upstream of the catalytic converter 7 of the second exhaust system includes a pipe length compensation element 12 by which length changes of the pipes caused by different heat exposure of the exhaust systems 4, 5, particularly during partial load engine operation, can be accommodated. The length compensation element 8 can accommodate compression and expansion forces to compensate for component expansions and contractions.

The cylinder bank 3 which can be deactivated, is provided with a vacuum generating means 14 which, in the embodiment shown, is an exhaust gas re-circulation system 15. By way of the exhaust gas re-circulation system 15, the exhaust pipe section 10 of the cylinder bank 2 which can be deactivated, is in communication with the intake duct of the cylinder bank 2, which is always operative during engine operation. The vacuum generating means 14 generates a low pressure in the exhaust pipe section 10 upstream of the pre-catalytic converters 18. As a result, during partial load engine operation when the cylinder bank 3 is deactivated, a partial exhaust gas stream is diverted from the exhaust system 4 of the cylinder bank 2 and flows, by way of the cross-over pipe section 8, through the pipe section 10 and through the exhaust gas re-circulation conduit 15 to the intake duct of the cylinder bank 2 as indicated by the arrows 22. The re-circulation of the exhaust gas keeps the pre-catalytic converters 18 in the pipe section 10 and the associated λ and control sensors at operating temperature. At the same time, the re-circulated exhaust gas is cooled whereby its density is reduced so that the exhaust gas re-circulation rate can be increased.

The exhaust gas re-circulation conduit 15 includes a control valve 16 by which the exhaust gas re-circulation conduit 15 can be closed when exhaust gas re-circulation is not needed or desired for the operation of the engine.

Figure 2:
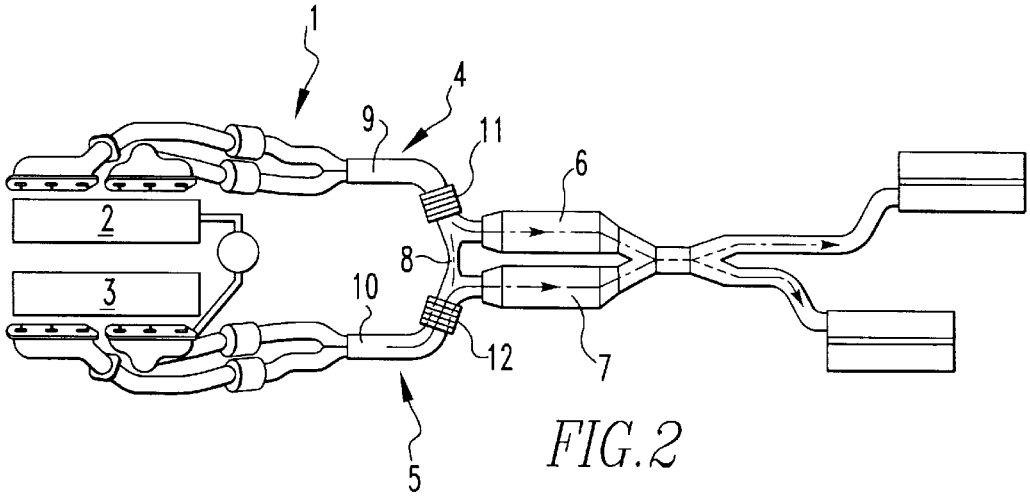
FIG. 2 shows a second embodiment of the engine.

FIG. 2 shows an arrangement similar to that shown in FIG. 1, wherein the internal combustion engine 1 also has two cylinder banks 2, 3 each with an exhaust system 4, 5 including catalytic converters 6, 7. Again, the exhaust systems 4, 5 are interconnected upstream of the catalytic converters 6, 7 in the area of the exhaust pipe sections 9, 10 by way of a pipe section 8. In this arrangement, each of the exhaust pipe sections 9, 10 of the two exhaust systems 4, 5 includes a length compensation element 11, 12.

Figure 3:
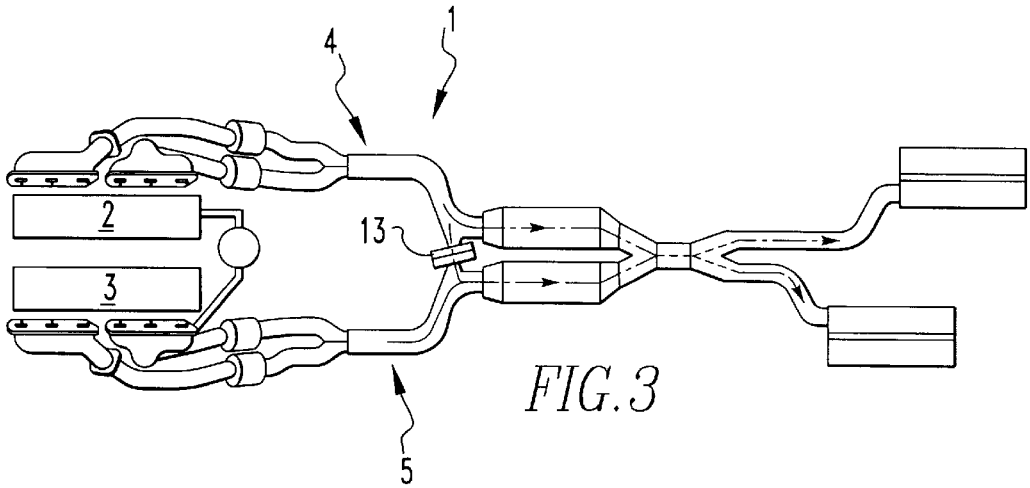
FIG. 3 shows a third embodiment of the engine.

FIG. 3 shows another embodiment wherein one length compensation element 13 is used which is disposed in the cross-over pipe section 8 between the two exhaust systems 4, 5 of the cylinder banks 2, 3.

However, it may be advisable to provide a length compensation element in each of the exhaust pipe sections 9, 10 and another one in the cross-over pipe section 8.

What is claimed is:

1. A multi-cylinder internal combustion engine comprising at least two cylinder banks each having an exhaust system including a catalytic converter and one of said cylinder banks being deactivatable during partial load operation of said engine when not all of said cylinder banks are needed for generation of power, said exhaust systems including exhaust pipe sections extending between said cylinder banks and said catalytic converters and being interconnected by a cross-over structure arranged upstream of said catalytic converters, and a length compensating element disposed in at least one of said exhaust pipe sections and said cross-over structure.

2. A multi-cylinder internal combustion engine according to claim 1, wherein said length compensating element is arranged in one of said exhaust pipe sections.

3. A multi-cylinder internal combustion engine according to claim 2, wherein a length compensating element is disposed in each exhaust pipe section.

4. A multi-cylinder internal combustion engine according to claim 1, wherein said exhaust pipe sections include pre-catalytic converters and a vacuum generating means is disposed in the exhaust pipe section of said deactivatible cylinder bank.

5. A multi-cylinder internal combustion engine according to claim 4, wherein said vacuum generating means includes an exhaust gas re-circulation conduit.

6. A multi-cylinder internal combustion engine according to claim 5, wherein said exhaust gas re-circulation conduit extends between said exhaust pipe section of said deactivatable cylinder bank and an intake duct of a cylinder bank which is always in operation when said engine is operated.

* * * * *